US012145819B2

(12) United States Patent
Matsui

(10) Patent No.: US 12,145,819 B2
(45) Date of Patent: Nov. 19, 2024

(54) IMAGE FORMING APPARATUS THAT SORTS SHEETS TO ONE OF TWO TRANSPORT ROUTES

(71) Applicant: KYOCERA Document Solutions Inc., Osaka (JP)

(72) Inventor: Shinya Matsui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 155 days.

(21) Appl. No.: 17/964,063

(22) Filed: Oct. 12, 2022

(65) Prior Publication Data

US 2023/0128020 A1 Apr. 27, 2023

(30) Foreign Application Priority Data

Oct. 22, 2021 (JP) ..... 2021-173003

(51) Int. Cl.

| | |
|---|---|
| ***B65H 85/00*** | (2006.01) |
| ***B65H 3/48*** | (2006.01) |
| ***B65H 5/06*** | (2006.01) |
| ***B65H 5/26*** | (2006.01) |
| ***B65H 7/06*** | (2006.01) |
| ***B65H 7/20*** | (2006.01) |
| ***B65H 29/62*** | (2006.01) |

(52) U.S. Cl.

CPC ..... *B65H 85/00* (2013.01); *B65H 3/48* (2013.01); *B65H 5/062* (2013.01); *B65H 5/26* (2013.01); *B65H 7/06* (2013.01); *B65H 7/20* (2013.01); *B65H 29/62* (2013.01); *B65H 2406/121* (2013.01); *B65H 2515/20* (2013.01); *B65H 2515/81* (2013.01); *B65H 2801/06* (2013.01)

(58) Field of Classification Search

CPC ..... B65H 29/58; B65H 29/585; B65H 29/60; B65H 29/62; B65H 29/64; B65H 85/00; G03G 15/234; G03G 15/6579; G03G 2215/00586

See application file for complete search history.

(56) References Cited

U.S. PATENT DOCUMENTS 8,712,310 B2 * 4/2014 Shimizu ..... B65H 3/5261 399/363
8,794,624 B2 * 8/2014 Herrmann ..... B65H 29/58 271/225

FOREIGN PATENT DOCUMENTS

JP 2010173763 A 8/2010

* cited by examiner

*Primary Examiner* — Jeremy R Severson

(74) *Attorney, Agent, or Firm* — IP Business Solutions, LLC.

(57) ABSTRACT

An image forming apparatus includes an image forming device, a transport route, a purge transport route, an image forming transport route, a transport roller, and a blowing machine. The image forming device forms an image on a sheet. The transport route extends to a predetermined position. The purge transport route extends to a downstream side in a sheet transport direction, from the predetermined position. The image forming transport route is branched from the purge transport route at the predetermined position, and extends toward the image forming device. The transport roller transports the sheet along the transport route, and along one of the purge transport route and the image forming transport route. The blowing machine delivers the sheet to one of the purge transport route and the image forming transport route, by blowing air to the sheet being transported along the transport route.

8 Claims, 3 Drawing Sheets

IMAGE FORMING APPARATUS THAT SORTS SHEETS TO ONE OF TWO TRANSPORT ROUTES

INCORPORATION BY REFERENCE

This application claims priority to Japanese Patent Application No. 2021-173003 filed on Oct. 22, 2021, the entire contents of which are incorporated by reference herein.

BACKGROUND

The present disclosure relates to image forming apparatus.

Some of existing image forming apparatuses are configured to distinguish a thickness of a recording sheet, and form an image under an image forming condition appropriate for the distinguished thickness.

SUMMARY

The disclosure proposes further improvement of the foregoing techniques. In an aspect, the disclosure provides an image forming apparatus including an image forming device, a transport route, a purge transport route, an image forming transport route, a transport roller, and a blowing machine. The image forming device forms an image on a sheet. The transport route extends to a predetermined position. The purge transport route extends to a downstream side in a sheet transport direction, from the predetermined position. The image forming transport route is branched from the purge transport route at the predetermined position, and extends toward the image forming device. The transport roller transports the sheet along the transport route, and along one of the purge transport route and the image forming transport route. The blowing machine delivers the sheet to one of the purge transport route and the image forming transport route, by blowing air to the sheet being transported along the transport route.

DETAILED DESCRIPTION

Figure 1:
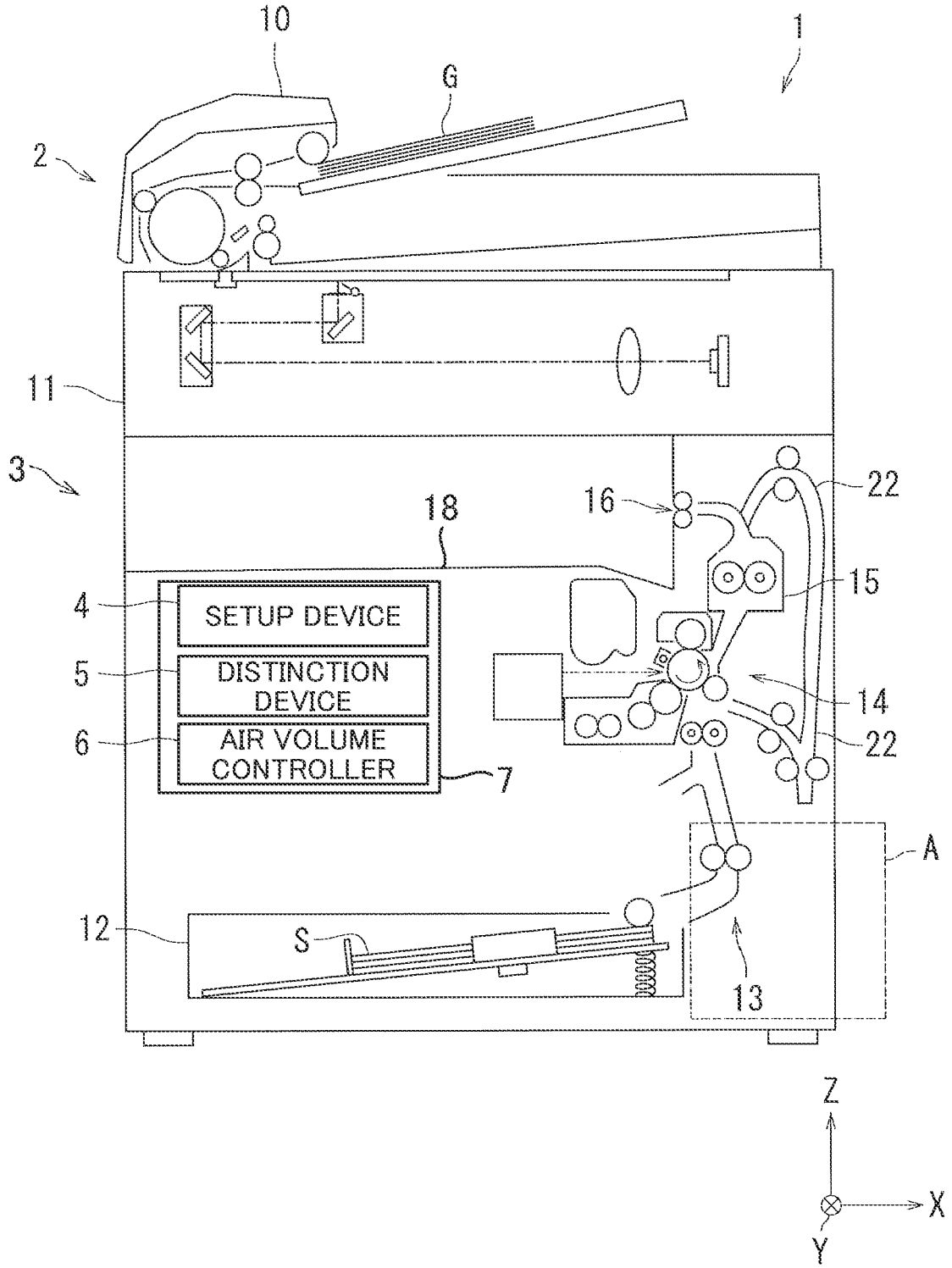
FIG. 1 is a cross-sectional view showing a structure of a multifunction peripheral including an image forming apparatus according to an embodiment of the disclosure.
Figure 2:
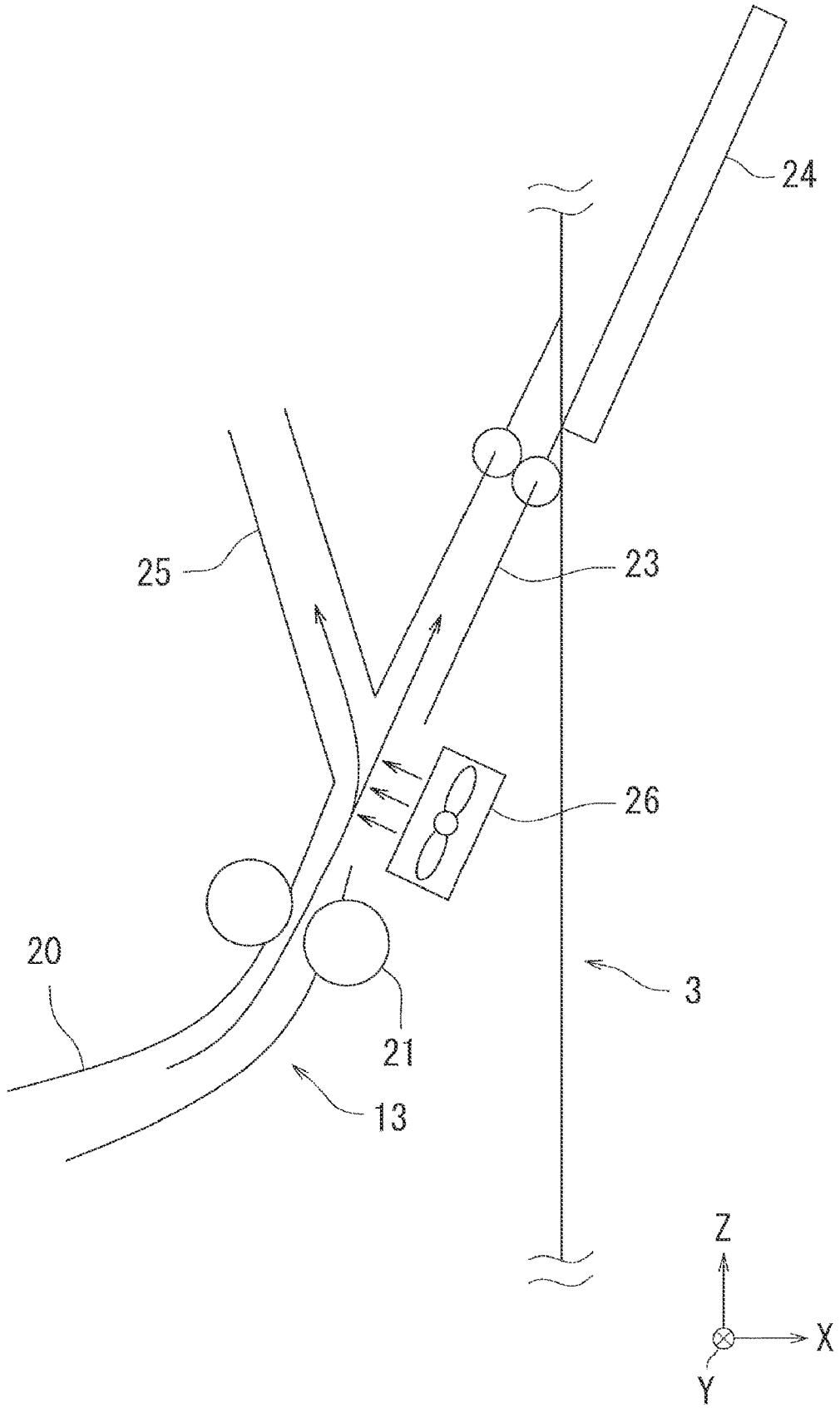
FIG. 2 is a schematic drawing showing a sheet transport device provided in the image forming apparatus.

Hereafter, an embodiment of the disclosure will be described, with reference to the drawings. In the drawings, the same or corresponding elements are given the same numeral, and the description of such elements will not be repeated. FIG. 1 and FIG. 2 each indicate an X-axis, a Y-axis, and a Z-axis which are orthogonal to each other. The Z-axis is parallel to a vertical plane. The X-axis and the Y-axis are parallel to a horizontal plane.

In this embodiment, the Z-axis direction, corresponding to the transport direction of a sheet S in an image forming device 14, may be referred to as a sub scanning direction, where appropriate. The Y-axis direction may be referred to as a main scanning direction. The X-axis direction may be referred to as the direction intersecting both of the main scanning direction and the sub scanning direction.

Referring to FIG. 1 and FIG. 2, a multifunction peripheral (MFP) 1 including a feeding device 13 according to the embodiment of the disclosure will be described hereunder. FIG. 1 illustrates a structure of the MFP 1. FIG. 2 schematically illustrates a sheet transport device 13 provided in the image forming apparatus 3. FIG. 2 is an enlarged view of a portion A in the sheet transport device 13 shown in FIG. 1.

Referring to FIG. 1, the MFP 1 has the functions of scanning, copying, printing, facsimile transmission, and so forth. The MFP 1 may be, for example, a copier or a facsimile machine, or a multifunction peripheral having both of such functions.

As shown in FIG. 1, the MFP 1 includes a document reading device 2, an image forming apparatus 3, and a control device 7. The control device 7 includes a processor. The control device 7 acts as a setup device 4, a distinction device 5, and an air volume controller 6, when the processor executes a control program stored in a read-only memory (ROM) or a hard disk drive (HDD). The setup device 4, the distinction device 5, and the air volume controller 6 may be realized, for example, by an application specific integrated circuit (ASIC), which acts as a processor.

The document reading device 2 includes a document transport device 10, and an image reading device 11. The document transport device 10 includes, for example, a document tray, a document feeding device, a document sensor, and a document discharge device. The document transport device 10 can be exemplified by an automatic document feeder (ADF).

The image reading device 11 includes an optical system. The optical system includes, for example, a light emitter, a lens, a reflecting mirror, and a photodetector. The image reading device 11 reads the image of a source document G transported by the document transport device 10. The image reading device 11 generates image data representing the image that has been read. The image reading device 11 can be exemplified by a scanner incorporated with a contact image sensor (CIS) or a charge-coupled device (CCD).

In this embodiment, the image forming apparatus 3 is a printer that employs an electrophotography process. The image forming apparatus 3 includes a sheet feeding device 12, a sheet transport device 13, the image forming device 14, a fixing device 15, and a sheet delivery device 16. The sheet feeding device 12 includes, for example, a sheet tray on which the sheet S is placed, and a sheet feeder.

The sheet transport device 13 includes a transport route 20, a transport roller 21, a reversing section 22, a purge transport route 23, a purge tray 24, an image forming transport route 25, and a blowing machine 26. The sheet S is transported along the transport route 20. The transport route 20 extends, from the sheet feeding device 12 as the start point, at least as far as the purge transport route 23 and the image forming transport route 25. In this embodiment, the transport route 20 extends from the sheet feeding device 12 to a predetermined first position, corresponding to the connection point to the purge transport route 23.

The transport roller 21 transports, by rotating, the sheet S along the transport route 20. The transport roller 21 is connected to a drive system, to be driven to rotate by the drive system. The drive system can be exemplified by a motor. A plurality of transport rollers 21 may be provided along the transport route 20. The transport roller 21 transports the sheet S along the transport route 20, and then along one of the purge transport route 23 and the image forming transport route 25.

The reversing section 22 reverses the sheet face, when the printing mode is set to a duplex printing mode, as will be subsequently described. The reversing section 22 may be included in the transport route 20, as shown in FIG. 1. The reversing section 22 extends to the downstream side in the sheet transport direction from the image forming device 14, and then again toward the image forming device 14, via a curved portion for reversing the sheet. The reversed sheet S is transported, for example by the transport roller 21, to the image forming device 14 through the reversing section 22.

The purge transport route 23 extends to the downstream side in the sheet transport direction, from the first position corresponding to the connection point to the transport route 20. The transport roller 21 transports the sheet S to be purged, along the purge transport route 23. The sheet S, transported along the purge transport route 23 and discharged to outside of the apparatus, is delivered to the purge tray 24. As shown in FIG. 2, for example a tray made of a resin is provided outside of the apparatus, to serve as the purge tray 24.

The rigidity of the sheet S varies depending on the type thereof. In general, a soft sheet S and a thin sheet S have low rigidity. In general, a hard sheet S and a thick sheet S have high rigidity.

When the sheet S having high rigidity is transported through the reversing section 22, the sheet S is subjected to large bending stress, at the sharp curve (i.e., curve of a small curvature radius) of the reversing section 22. Accordingly, the sheet S having high rigidity may fail to pass the reversing section 22, and cause paper jam. Therefore, when the sheet S having high rigidity, which is unable to be reversed in the reversing section 22, is transported along the transport route 20 in the duplex printing mode, it is preferable that the sheet S is delivered to the purge transport route 23, instead of the reversing section 22.

Here, an image forming apparatus that switches the transport route depending on the rigidity of the sheet is unknown yet.

According to this embodiment, however, when the printing mode is set to the duplex printing mode, the transport roller 21 transports the sheet S having high rigidity, which is unable to be reversed in the reversing section 22, along the purge transport route 23. Such an arrangement prevents occurrence of paper jam in the apparatus.

It is preferable that the purge transport route 23 extends in the same direction as the transport route 20, because such a configuration facilitates the sheet S having high rigidity to be smoothly delivered to the purge transport route 23, from the transport route 20.

The image forming transport route 25 is branched from the purge transport route 23 at the first position, and extends toward the image forming device 14 on the downstream side in the sheet transport direction. In this embodiment, the image forming transport route 25 is branched from the purge transport route 23 at the first position, and extends as far as the image forming device 14. The transport roller 21 transports the sheet S along the image forming transport route 25, to the image forming device 14. Here, the image forming transport route 25 may be configured to extend toward the image forming device 14, from a predetermined second position on the transport route 20 which is different from the first position.

According to this embodiment, when the printing mode is set to the duplex printing mode, the transport roller 21 transports the sheet S having such rigidity that enables the sheet S to be reversed in the reversing section 22, along the image forming transport route 25. In other words, in the duplex printing mode, the sheet S having low rigidity, which can be reversed in the reversing section 22, is guided to the image forming device 14, through the image forming transport route 25, so that the duplex printing can be smoothly executed.

According to this embodiment, when the printing mode is set to the simplex printing mode, the transport roller 21 transports all types of the sheet S, along the image forming transport route 25. This is because the sheet S is not passed through the reversing section 22, in the simplex printing mode. Therefore, all types of sheet S are guided to the image forming device 14 through the image forming transport route 25, regardless of the extent of the rigidity.

Consequently, in the simplex printing mode, the printing operation can be properly executed on all types of sheet S, regardless of the extent of the rigidity.

In this embodiment, the blowing machine 26 blows air to the sheet S being transported along the transport route 20, thereby delivering the sheet S to one of the purge transport route 23 and the image forming transport route 25. The blowing machine 26 can be exemplified by a fan. The blowing machine 26 is located on the transport route 20. The blowing machine 26 may be located at the branch point between the purge transport route 23 and the image forming transport route 25, on the transport route 20. The blowing machine 26 may be located upstream of the branch point between the purge transport route 23 and the image forming transport route 25, in the sheet transport direction, on the transport route 20. The blowing machine 26 is located in the proximity of the transport route 20, and blows air from the side of the purge transport route 23, to the side of the image forming transport route 25.

The leading edge of the sheet S having high rigidity, being transported along the transport route 20, overcomes wind pressure, despite being blown by the blowing machine 26. Accordingly, the sheet S enters the purge transport route 23, without changing the direction. On the other hand, the leading edge of the sheet S having low rigidity, being transported along the transport route 20, is curved upon being blown by the blowing machine 26. Accordingly, the transport direction of the sheet S is changed, such that the sheet S is delivered to the image forming transport route 25. As result, the sheet S can be delivered to the appropriate transport route, according to the rigidity of the sheet S.

The reversing section 22 includes the curved portion for making a U-turn. Accordingly, the sheet S is subjected to large bending stress, at the point of making the U-turn. In the reversing section 22, only the sheet S having such low rigidity that allows the sheet S to be bent by the bending stress, can pass the point of making the U-turn. When the blowing machine 26 blows air with wind pressure corresponding to the bending stress exerted to the sheet S in the reversing section 22, the leading edge of the sheet S having high rigidity being transported along the transport route 20 overcomes the wind pressure. Therefore, such sheet S is delivered to the purge transport route 23, without changing the direction. On the other hand, the leading edge of the sheet S having low rigidity being transported along the transport route 20 is defeated by the wind pressure of the air blown by the blowing machine 26. Therefore, the transport direction of the sheet S is changed, so as to be delivered to the image forming transport route 25.

In this embodiment, accordingly, the air volume controller 6 causes the blowing machine 26 to blow air, with the wind pressure corresponding to the bending stress exerted to the sheet S in the reversing section 22, when the printing mode is set to the duplex printing mode. In this case, only the sheet S having low rigidity is transported through the reversing section 22 in the duplex printing mode, and therefore the occurrence of paper jam in the reversing section 22 can be prevented.

In this embodiment, further, the air volume controller 6 causes the blowing machine 26, when the printing mode is set to the simplex printing mode, to blow air with the wind pressure larger than the bending stress exerted to the sheet S in the reversing section 22. In the simplex printing mode, the sheet S is not passed through the reversing section 22. Accordingly, all types of sheet S may be guided to the image forming device 14 through the image forming transport route 25, regardless of the extent of the rigidity.

When the blowing machine 26 blows air with the wind pressure larger than the bending stress exerted to the sheet S in the reversing section 22, the leading edge of the sheet S having high rigidity is also defeated by the wind pressure, so that the transport direction of the sheet S is switched to the image forming transport route 25. The leading edge of the sheet S having low rigidity is naturally defeated by the wind pressure, so that the transport direction of the sheet S is switched to the image forming transport route 25. As result, all types of sheet S are guided to the image forming device 14. Consequently, in the simplex printing mode, the printing operation can be properly executed on all types of sheet S, regardless of the extent of the rigidity.

As described above, the image forming apparatus 3 is a printer based on the electrophotography process in this embodiment, unless specifically described as an ink jet printer. The image forming device 14 includes, for example, an image data input device, a charging device, an exposure device, a developing device, a transfer device, and a cleaning device. The image forming device 14 forms a toner image on the sheet S, on the basis of the image data.

Here, the image forming apparatus 3 may be an ink jet printer instead. When the image forming apparatus 3 is the ink jet printer, the image forming device 14 at least includes an ink tank, an ink cartridge, and an ink head. The image forming device 14 forms an ink image on the sheet S, on the basis of the image data. When the image forming apparatus 3 is the ink jet printer, image forming apparatus 3 may be without the fixing device 15.

The fixing device 15 heats and presses the toner image formed on the sheet S, thereby fixing the toner image onto the sheet S. The fixing device 15 includes, for example, a fixing belt, a pressure roller, and a heater.

The fixing belt has a hollow cylindrical shape. The pressure roller is pressed against the fixing belt, so as to define a nip region in collaboration therewith. The pressure roller causes the fixing belt to rotate upon being driven by a drive device.

The heater heats up the fixing belt, with power supplied from a power source. The heater is located in the vicinity of the inner circumferential surface of the fixing belt. The sheet S, transported by a sheet transport device to be subsequently described, is heated by the heater when passing through the nip region, so that the toner image is fixed onto the sheet S.

The sheet delivery device 16 delivers the sheet S to outside of the casing of the MFP 1. The sheet delivery device 16 includes a delivery roller and an output tray 18. The delivery roller delivers the sheet S, transported from the fixing device 15 along the transport route 20 by the transport roller 21, to the output tray 18. On the output tray 18, the delivered sheet S is placed.

The setup device 4 sets the printing mode. The setup device 4 may be configured to set the simplex printing mode and the duplex printing mode.

The distinction device 5 identifies the printing mode. The distinction device 5 identifies the printing mode set by the setup device 4. The distinction device 5 may be configured to distinguish between the simplex printing mode and the duplex printing mode.

The air volume controller 6 controls the wind pressure of the blowing machine 26. The air volume controller 6 may also control the respective operations of the blowing machine 26, the setup device 4, and the distinction device 5.

Figure 3:
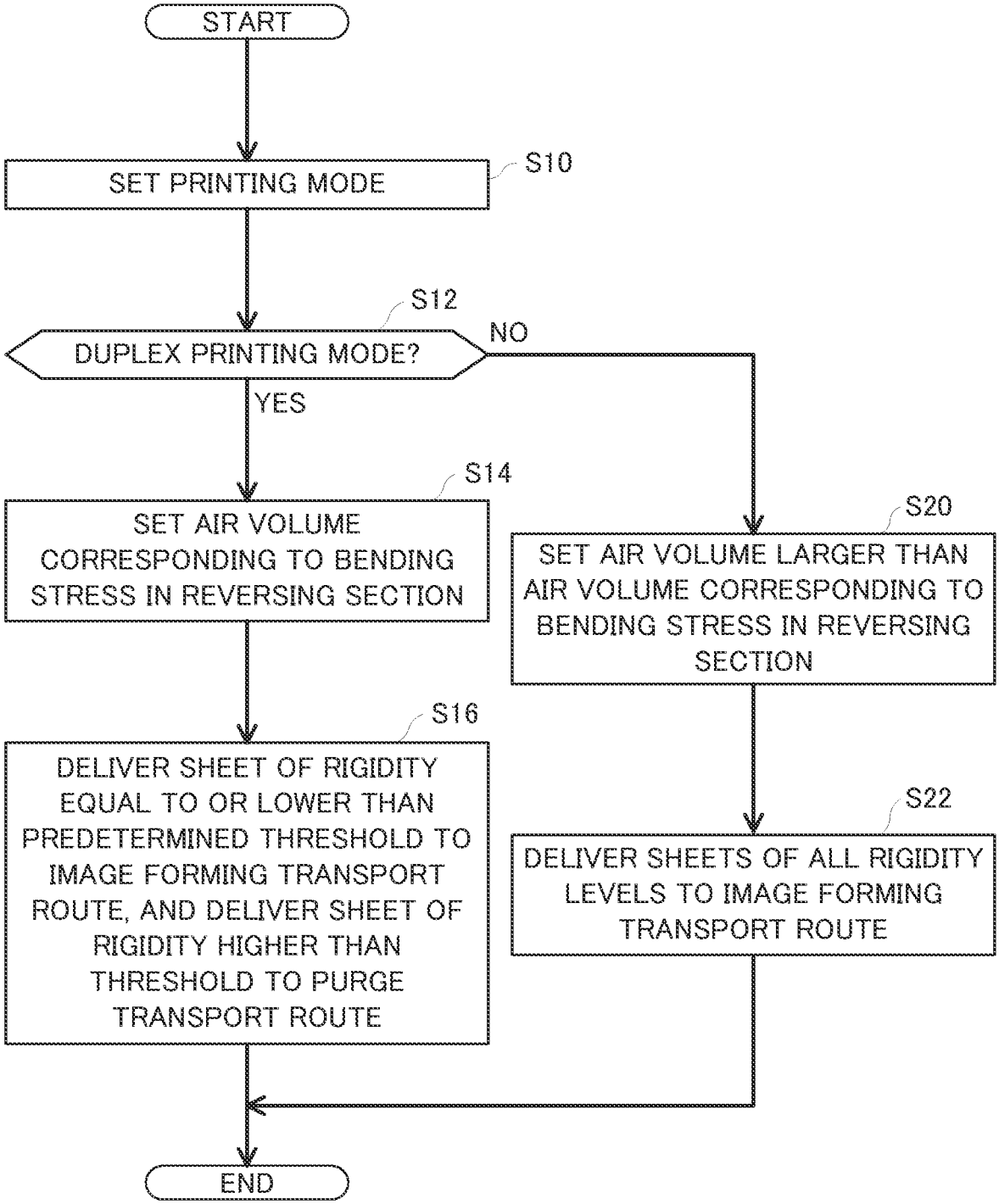
FIG. 3 is a flowchart showing a sheet sorting process.

Referring now to FIG. 3, a sheet sorting process performed by the image forming apparatus 3 according to this embodiment will be described. FIG. 3 is a flowchart showing the sheet sorting process according to this embodiment. As shown in FIG. 3, the sheet sorting process includes step S10 to step S22, each of which will be sequentially described hereunder.

At step S10, the setup device 4 sets the printing mode. After step S10, the operation proceeds to step S12. At step S12, the distinction device 5 decides whether the setup device 4 has set the duplex printing mode. When the duplex printing mode is set (YES at step S12), the operation proceeds to step S14. In the case where the duplex printing mode is not set (NO at step S12), the operation proceeds to step S20.

When the duplex printing mode is set (YES at step S12), the air volume controller 6 sets the blowing machine 26 to output an air volume corresponding to the bending stress in the reversing section 22, at step S14. After step S14, the operation proceeds to step S16.

At step S16, the blowing machine 26 blows air to the sheet S being transported along the transport route 20, with the air volume set as above. With such operation, the blowing machine 26 delivers the sheet S having rigidity equal to or lower than a predetermined threshold to the image forming transport route 25, and delivers the sheet S having higher rigidity than the predetermined threshold to the purge transport route 23. After step S16, the sheet sorting process is finished.

In the case where the duplex printing mode is not set (NO at step S12), the air volume controller 6 sets the blowing machine 26 to output an air volume larger than the air volume corresponding to the bending stress in the reversing section 22, at step S20. After step S20, the operation proceeds to step S22.

At step S22, the blowing machine 26 blows air to the sheet S being transported along the transport route 20, with the air volume set at step S20. Accordingly, the blowing machine 26 delivers the sheet S of all levels of rigidity, to the image forming transport route 25. After step S22, the sheet sorting process is finished.

The embodiment of the disclosure has been described thus far, with reference to the drawings. However, the disclosure is not limited to the foregoing embodiment, but may be implemented in various different manners, without departing from the scope of the disclosure. The drawings schematically illustrate the constituent elements for the sake of clarity, and the number of pieces of the illustrated constituent elements may be different from the actual number, depending on the availability of space on the drawing sheet. Further, the constituent elements referred to in the embodiment are merely exemplary and not specifically limited, and therefore may be modified in various manners, without substantially compromising the advantageous effects of the disclosure.

INDUSTRIAL APPLICABILITY

The disclosure is applicable to the technical field of the image forming apparatus.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image forming device that forms an image on a sheet;

a transport route extending to a predetermined position;

a purge transport route extending to a downstream side in a sheet transport direction, from the predetermined position;

an image forming transport route branched from the purge transport route at the predetermined position, and extending toward the image forming device;

a transport roller that transports the sheet along the transport route, and along one of the purge transport route and the image forming transport route;

a blowing machine that delivers the sheet to one of the purge transport route and the image forming transport route, by blowing air to the sheet being transported along the transport route;

a control device including a processor, and configured to act, when the processor executes a control program, as an air volume controller that controls wind pressure of the blowing machine; and a reversing section being provided downstream of the image forming transport route in the sheet transport direction, and including a curved portion for reversing a face of the sheet, wherein the blowing machine is located in a proximity of a branch point of the transport route, and blows air from a side of the purge transport route to a side of the image forming transport route, wherein the air volume controller causes the blowing machine to blow air with the wind pressure corresponding to a bending stress exerted to the sheet in the reversing section.

2. The image forming apparatus according to claim 1, wherein the purge transport route extends in a same direction as the transport route.

3. An image forming apparatus comprising:

an image forming device that forms an image on a sheet;

a transport route extending to a predetermined position;

a purge transport route extending to a downstream side in a sheet transport direction, from the predetermined position;

an image forming transport route branched from the purge transport route at the predetermined position, and extending toward the image forming device;

a transport roller that transports the sheet along the transport route, and along one of the purge transport route and the image forming transport route;

a blowing machine that delivers the sheet to one of the purge transport route and the image forming transport route, by blowing air to the sheet being transported along the transport route;

a control device including a processor, and configured to act, when the processor executes a control program, as a setup device that sets a printing mode, and an air volume controller that controls wind pressure of the blowing machine; and a reversing section including a curved portion for reversing a face of the sheet, and to be used to reverse the face of the sheet when the printing mode is set to a duplex printing mode, wherein the air volume controller causes the blowing machine, when the printing mode is the duplex printing mode, to blow air with the wind pressure corresponding to a bending stress exerted to the sheet in the reversing section.

4. The image forming apparatus according to claim 3, wherein the air volume controller causes the blowing machine, when the printing mode is a simplex printing mode, to blow air with the wind pressure higher than the pressure corresponding to the bending stress exerted to the sheet in the reversing section.

5. The image forming apparatus according to claim 4, wherein the transport roller transports all types of the sheet along the image forming transport route, when the printing mode is the simplex printing mode.

6. The image forming apparatus according to claim 3, wherein the transport roller transports the sheet having rigidity that disables the sheet to be reversed in the reversing section, along the purge transport route, when the printing mode is the duplex printing mode.

7. The image forming apparatus according to claim 3, wherein the transport roller transports the sheet having rigidity that enables the sheet to be reversed in the reversing section, along the image forming transport route, when the printing mode is the duplex printing mode.

8. The image forming apparatus according to claim 3, wherein the blowing machine is located in a proximity of the transport route, and blows air from a side of the purge transport route to a side of the image forming transport route.

* * * * *